US006341464B1

(12) United States Patent
Dickey et al.

(10) Patent No.: US 6,341,464 B1
(45) **Date of Patent: *Jan. 29, 2002**

(54) SIDING PANEL WITH INTERLOCK

(75) Inventors: Eric B. Dickey, Overland Park; Essi Salamatbakhsh, Prairie Village, both of KS (US); Lewis F. Huebner, Kearney; Dan Parks, Blue Springs, both of MO (US)

(73) Assignee: Variform, Inc., Kearney, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/518,868

(22) Filed: Mar. 3, 2000

Related U.S. Application Data

(63) Continuation of application No. 09/053,475, filed on Apr. 1, 1998, now Pat. No. 6,065,260.

(51) Int. Cl.[7] ..... E04B 1/00
(52) U.S. Cl. ..... 52/547; 52/529; 52/530
(58) Field of Search ..... 52/529, 530, 547

(56) References Cited

U.S. PATENT DOCUMENTS

| | | | |
|---|---|---|---|
| 1,336,945 | A | 4/1920 | Dickelman |
| 2,250,764 | A | 7/1941 | Hoess |
| 2,258,247 | A | 10/1941 | Hull |
| 2,706,838 | A | 4/1955 | Sears |
| 3,161,924 | A | 12/1964 | Noecker |
| 3,325,952 | A | 6/1967 | Trachtenberg |
| 3,383,819 | A | 5/1968 | Zimmer et al. |
| 3,537,218 | A | 11/1970 | Hindman |
| 3,596,420 | A | 8/1971 | Decker |
| 3,785,675 | A | 1/1974 | Norris et al. |
| 3,810,774 | A | 5/1974 | Pittman |
| 3,827,201 | A | 8/1974 | Struben |
| 3,832,813 | A | 9/1974 | Hindman |
| RE28,987 | E | 10/1976 | Iacona |
| 4,010,584 | A | 3/1977 | Barnes, Jr. |
| 4,043,088 | A | 8/1977 | Payton |
| 4,122,643 | A | 10/1978 | Hafner |
| 4,400,919 | A | 8/1983 | Szabo et al. |
| 4,549,378 | A | 10/1985 | Ayers et al. |
| 4,580,384 | A | 4/1986 | Hutcheson |

(List continued on next page.)

FOREIGN PATENT DOCUMENTS

FR 2015134 4/1970

OTHER PUBLICATIONS

Parkside Ventilated Vinly Skirting brochure; Georgia–Pacific (1996) Variform Vinyl Skirting System brochure (2 pages); 1992; Variform, Inc.
T–Lok Vinyl Skirt brochure (2 pages); 1991; Alcoa Building Products, Inc.
25th Anniversary Catalog brochure (3 pages); 1967; Kaufman Mobile Home Supplies, Inc.
Vented T–Lok Skirting Panel brochure (1 page).

*Primary Examiner*—Beth A. Stephan
*Assistant Examiner*—Brian E. Glessner
(74) *Attorney, Agent, or Firm*—Lathrop & Gage, L.C.

(57) ABSTRACT

A siding panel is provided for attachment to a structure and connection to a similar overlapping siding panel in interlocking relationship. The panel includes a strip for attachment, such as by nailing, to a supporting structure, a receiver formed by outer and inner bends, at least one stretch extending away from the strip and presenting a gap between the outer bend and the stretch, a base and a projection, all extending the length of the panel. The projection is configured to interfit with a receiver of an adjacent panel, with the projection including a flange, a return bend and a cantilever leg. The projection snap fits into the receiver, with the cantilever leg deflecting as the return bend flexes to permit passage of the projection into the receiver.

20 Claims, 1 Drawing Sheet

U.S. PATENT DOCUMENTS

| | | | | | |
|---|---|---|---|---|---|
| 4,715,157 | A | * | 12/1987 | Funaki | 52/529 |
| 4,843,793 | A | | 7/1989 | Ayers | |
| 5,022,207 | A | | 6/1991 | Hartnett | |
| D355,494 | S | | 2/1995 | Fenske | |
| 5,461,839 | A | | 10/1995 | Beck | |
| 5,465,543 | A | | 11/1995 | Seifert | |
| 5,475,963 | A | | 12/1995 | Chelednik | |
| 5,490,359 | A | | 2/1996 | Hepler | |
| 5,526,627 | A | | 6/1996 | Beck | |
| D382,351 | S | | 8/1997 | Baxter et al. | |
| 5,768,844 | A | | 6/1998 | Grace, Sr. et al. | |
| 5,878,543 | A | * | 3/1999 | Mowery | 52/529 X |

* cited by examiner

SIDING PANEL WITH INTERLOCK

This application is a continuation of U.S. patent application Ser. No. 09/053,475, filed Apr. 1, 1998 now U.S. Pat. No. 6,065,260.

BACKGROUND OF THE INVENTION

1. Field of the Invention

This invention relates generally to a panel with an elongated, normally horizontal interlock useful for holding overlapping panels in engagement and presenting a pleasing ornamental appearance. More particularly, it is concerned with a panel having an improved interlock structure which provides improved attachment, increased durability, and greater rigidity to the panel.

2. Description of the Prior Art

Vinyl and metal siding is used to provide a decorative and protective sheathing over buildings. The siding is typically nailed to the underlying structure, with successive overlapping courses of siding panels nailed to the building walls. Most typically, the siding presents the appearance of clapboards in lapping arrangement which provides a decorative appearance and sheds rain or other moisture.

It is desirable to provide an interlock structure to connect adjacent overlapping siding panels. A decorative siding interlock panel is shown in U.S. Pat. No. Design 382,351, which provides a panel which includes an interlock but hides the interlock from the view of an observer when applied to a building. While this siding panel design has ornamental advantages, it is believed that structural improvements would enhance the performance of the panel in use.

Thus, there has developed a need for a siding panel which is not only attractive, but also provides improved rigidity, durability, and interlocking performance.

SUMMARY OF THE INVENTION

These objects have largely been solved by the siding panel of the present invention. That is to say, the siding panel hereof retains the attractive appearance of the prior art panel, but yields improved performance and resists damage during installation by providing a superior interlock design.

The siding panel hereof is preferably formed as an elongated panel presenting a nailing strip along the top with a receiver positioned just below the nailing strip in normal orientation. The receiver is configured to present a recess formed by bending the panel to project forwardly of the surface of the underlying structure and then returning in a pair of lower and upper bends forming a serpentine loop. A stretch portion of the panel projects downwardly and adjacent the surface of the underlying structure from the serpentine loop. One or more stretches extend downwardly to the bottom of the panel, which is provided with a projection for insertion in snap-fitting relationship with the receiver. The projection is formed by bending the panel inwardly toward the structure from the lowermost stretch, providing a second bend extending normally upwardly, and a third or return bend forming a hairpin with the free leg oriented normally downwardly and away from the top of the panel.

The projection preferably has a greater transverse dimension than the clearance between the lower bend and the stretch portion of the panel located above and adjacent thereto, so that an interference fitting is created. As a result, a positive and audible "snap" sound is created when the projection moves past the clearance into the receiver. Moreover, the free leg serves to bias the projection against the receiver of the next upper panel, to enhance the holding power of the connection. Because of this holding relationship, as the panel forming a part of an adjacent and upper course has its projection inserted into the receiver of the lower panel already nailed in place, the installer may use the interlock thereby created to hold the panel in position while retrieving a level, hammer or other tool before nailing the upper panel in place. This greatly facilitates the installation of the panels and reduces labor. Moreover, the configuration of the interlock permits easy discoinection between adjacent panels by simply pulling downwardly on the uppermost panel to release the connection. As an added benefit, the improved panel configuration has been found to provide substantial improvements in rigidity in resisting deflection of the panel, wherein testing has revealed improvements of up to 40% for 12 foot length panels. In addition, the rounded edge of the projection is less likely to catch or bind during insertion into the receiver, and less likely to break since the free edge, which typically thins out during manufacturing, is oriented away from the direction of insertion.

As a result, a superior panel is provided which provides both qualitative and quantitative levels of improvement over prior art panels. The benefits noted above and other improvements will be readily apparent to those skilled in the art with reference to the drawings and the attached description.

DESCRIPTION OF THE PREFERRED EMBODIMENT

Figure 1:
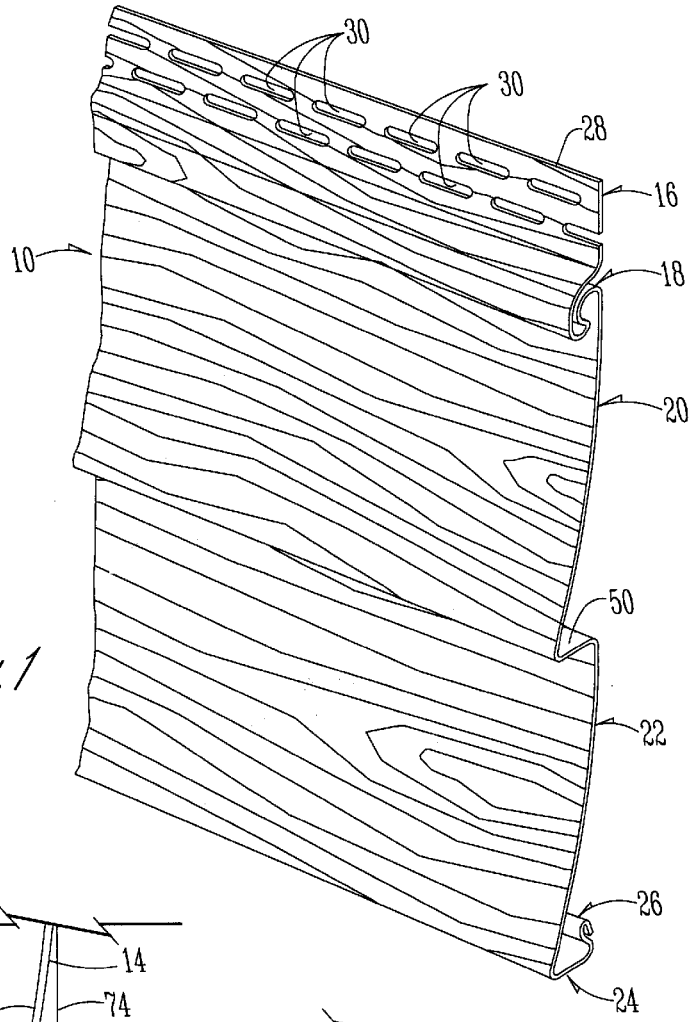
FIG. 1 is a foreshortened perspective view of a siding panel in accordance with the present invention in its normal horizontal orientation, showing the nailing strip along the top of the panel and the projection along the bottom of the panel.

Referring now to the drawing, a siding panel 10 in accordance with the present invention is preferably manufactured as single elongated article from a unitary sheet of synthetic resin such as polyvinyl chloride. One preferred technique is extruding the panel 10 which is shaped by passing through dies to achieve the desired configuration. The panel presents a front side 12 which may be embossed with a pattern such as simulated woodgrain and a back side 14 which typically lacks such embossing. Broadly speaking, the panel presents a nailing strip 16, a receiver 18, at least one and preferably a plurality of stretches 20 and 22, and a base 24 having a projection 26. The panel 10 hereof is described in its typical generally horizontal orientation as shown in FIG. 1, but may also be oriented vertically or at other angles as desired.

Figure 2:
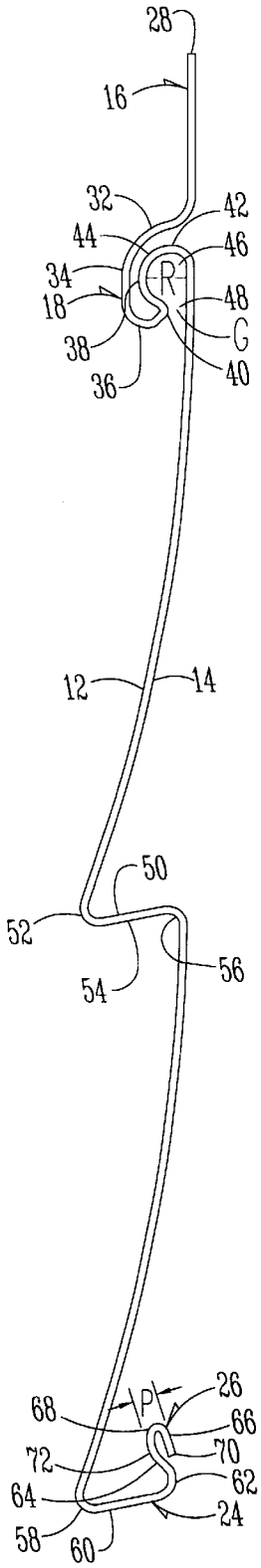
FIG. 2 is a side elevational view of the siding panel hereof, showing the receiver located below and forwardly of the nailing strip.
Figure 3:
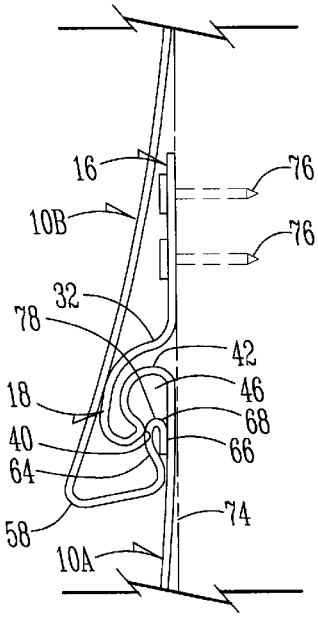
FIG. 3 is an enlarged fragmentary side elevational view of adjacent overlapping upper and lower panels of the present invention, showing the lower panel nailed to a supporting structure and the upper panel positioned for insertion of its projection into the receiver of the lower panel.
Figure 4:
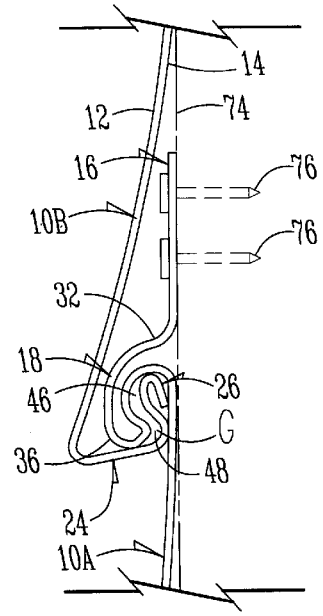
FIG. 4 is an enlarged fragmentary side elevational view similar to FIG. 3, showing the projection of the upper panel fully inserted into the receiver of the lower panel in interlocking engagement.

The nailing strip 16 is positioned uppermost on the panel 10 and includes a substantially flat span extending downwardly from edge 28, the strip 16 presenting a plurality of perforations 30 therein. The perforations 30 are typically elongated horizontally to permit expansion and contraction along the length of the panel 10 due to changes in temperature. The receiver 18 is positioned just below the nailing strip 16 to allow adjacent panels 10A and 10B to overlap as shown in FIGS. 3 and 4, thereby aiding in shedding precipitation. The receiver 18 includes a forward bend 32 to provide space for folding of the panel 10 to receive a projection 26 of an adjacent panel, and a curved face 34 which combine to present an ornamentally pleasing configuration. The curved face 34 extends normally downwardly to an outer hairpin bend 36 which routes the following arc segment 38 upwardly and toward the nailing strip 16 as shown in FIG. 2. The outer hairpin bend 36 includes an inner edge 40. Arc segment 38 continues in a curved presentation to liner bend 42 which ends in first stretch 20. A serpentine loop 44 is presented by outer hairpin bend 36, arc segment 38 and inner bend 42, with a recess 46 presented thereby. A gap G between inner edge 40 and first stretch 20 has a reduced transverse dimension which is smaller than the transverse dimension of the widest dimension R within the recess 46.

The first stretch 20 continues downwardly toward the base 24. A second stretch 22 is normally located below the first stretch 20, and is staggered below the first stretch by a lap 50. Stretches 20 and 22 are shown in a conventional straight clapboard presentation, but may be provided in other well-known presentations such as dutch lap or ship lap stylings. Lap 50 is intended to present the appearance of clapboard wood siding and includes a nose 52, a shelf 54 and a trough 56. Base 24 is positioned at the bottom of second stretch 22, and configured to be similar in appearance to lap 50 when panels 10A and 10B are interlocked and viewed facing the front side 12.

The base 24 includes an elbow 58 and a rearwardly projecting base leg 60. Crook-shaped projection 26 extends upwardly toward nailing strip 16 from the base curve 62 at the rear portion of base leg 60. The projection 26 includes a flange 64 and a cantilever leg 66 which is oriented opposite the flange 64 and joined thereto by a return bend 68. Return bend 68 causes the angle between the flange 64 exiting the base curve 62 and the tip 70 at the end of cantilever leg 66 to be more than 90 degrees, and preferably more than 180 degrees. The flange 64 is curved at its upper end 72 adjacent return bend 68, causing projection 26 and base curve 62 to have a serpentine appearance.

The configuration of projection 26 and receiver 18 is complemental to permit interlocking of overlapping panels 10A and 10B as illustrated in FIGS. 3 and 4, where the panel 10A is shown fixed to a supporting structure 74 such as a building by nails 76 inserted through projections 30 and pounded into the structure 74. In FIG. 3, the projection 26 of the upper panel 10B is shown moving upwardly just prior to locking into the receiver 18 of lower panel 10A. The cantilever leg 66 is flexing toward flange 64 to permit the projection 26 to move past gap G. The unflexed transverse dimension P of projection 26 is normally greater than the dimension G of gap, but by flexing the return bend 68 and the bending of cantilever leg 66 toward the flange 64, the projection 26 is able to slide into the recess 46 in receiver 18 as shown in FIG. 4. The curved upper end 72 of flange 64 facilitates the movement of projection 26 past gap 48, and because return bend 68 presents an outside convex surface 78 and is located uppermost on the projection 26 as it moves into receiver 18, entry of the projection is facilitated and not hindered by any sharp edge. Further, the tendency of the tip 70 to thin out as it leaves the mold is of less importance as the return bend 68 enters the recess 46 first and thereby acts as a leading edge effectively protecting the tip 70 at the trailing end of the projection.

After entry of the projection 26 into the recess 46 in interlocking relationship as shown in FIG. 4, the cantilever leg 66 flexes back to its original position to further facilitate a good interlocking relationship. Cantilever leg of uppermost panel 10B provides a biasing force away from the first stretch 20 of panel 10A and thus serves to restore the unflexed transverse dimension P and thus resist downward movement of the panel 10B out of interlocking engagement with panel 10A. This permits the installer to let go of the upper panel 10B temporarily while it remains attached to the lower panel 10A. The strip 16, receiver 18, stretches 20 and 22, base 24 and projection 26 extend substantially the length of the panel 10, which are typically available in elongated lengths of twelve feet, sixteen feet or even longer.

It may thus be seen that without materially changing the outward appearance from that shown in U.S. Pat. No. Design 382,351, a superior panel 10 is provided with improved rigidity, interlocking, and protection during connection.

What is claimed is:

1. A siding panel comprising:

a base comprising a base leg and a base curve connected to the base leg; and a projection comprising:

a flange extending from the base curve;

a cantilever leg positioned opposite the flange and interconnected with the flange by a return bend;

wherein the cantilever leg comprises a substantially planar member having an end substantially opposite to an interconnection with the return bend and is adapted to provide a biasing force away from a surface.

2. The siding panel of claim 1 wherein the return bend comprises an angle of greater than ninety degrees.

3. The siding panel of claim 1 wherein the return bend comprises an angle of greater than one hundred eighty degrees.

4. The siding panel of claim 1 further comprising a strip for attachment to a supporting structure.

5. The siding panel of claim 1 further comprising:

a receiver comprising an outer bend and an inner bend forming a serpentine loop and presenting a recess having a transverse dimension; and at least one stretch adjacent the receiver and presenting a gap between the outer bend of the receiver and the stretch, the gap having a transverse dimension less than the transverse dimension of the recess.

6. The siding panel of claim 1 wherein the return bend has an outside convex surface.

7. The siding panel of claim 1 further comprising at least one stretch connected to the base leg.

8. The siding panel of claim 1 wherein the surface comprises a stretch of another panel.

9. A siding panel comprising:

a base comprising a base leg and a base curve connected to the base leg; and a projection comprising:

a flange extending from the base curve;

a cantilever leg positioned opposite the flange; and a return bend interconnecting the flange and the cantilever leg, the return bend being approximately u-shaped;

wherein the cantilever leg comprises a substantially planar member having an end substantially opposite to an interconnection with the return bend and is adapted to provide a biasing force away from a surface.

10. The siding panel of claim 9 wherein the return bend comprises an angle of greater than ninety degrees.

11. The siding panel of claim 9 wherein the return bend has an outside convex surface.

12. The siding panel of claim 9 further comprising a strip for attachment to a supporting structure.

13. The siding panel of claim 9 further comprising at least one stretch connected to the base leg.

14. The siding panel of claim 9 wherein the surface comprises a stretch of another panel.

15. A siding panel configured to interlock with a receiver having a gap comprising:

a base comprising a base leg and a base curve connected to the base leg; and a projection comprising:

a flange comprising a lower end extending from the base curve and a curved upper end;

a cantilever leg positioned opposite the flange; and a return bend presenting an outside convex surface and interconnecting the curved upper end of the flange and the cantilever leg, the return bend having a narrowing apex so that the curved upper end, the outside convex surface, and the narrowing apex are adapted to facilitate entry of the projection into the gap of the receiver;

wherein an unflexed transverse dimension of the projection is greater than the gap of the receiver.

16. The siding panel of claim 15 wherein the cantilever leg is adapted to provide a biasing force away from a surface.

17. The siding panel of claim 16 wherein the surface comprises a stretch of another panel.

18. The siding panel of claim 15 wherein the return bend comprises an angle of greater than ninety degrees.

19. The siding panel of claim 15 further comprising a strip for attachment to a supporting structure.

20. The siding panel of claim 15 further comprising at least one stretch connected to the base leg.

* * * * *